United States Patent [19]

Foley

[11] 3,967,376

[45] July 6, 1976

[54] CLEAN UP/CUT SPOON

[76] Inventor: Donald E. Foley, c/o George Spector, 3615 Woolworth Bldg., 233 Broadway, New York, N.Y. 10007

[22] Filed: Feb. 5, 1974

[21] Appl. No.: 440,133

[52] U.S. Cl. ..... 30/150; 30/149

[51] Int. Cl.[2] ..... A47J 43/28

[58] Field of Search ..... 30/142, 147, 149, 150, 30/324, 326, 162

[56] References Cited

UNITED STATES PATENTS

| | | | |
|---|---|---|---|
| 937,613 | 10/1909 | Kohonke | 30/149 |
| 1,534,202 | 4/1925 | Boley | 30/150 |
| 2,532,696 | 12/1950 | Comstock | 30/326 |

*Primary Examiner*—Al Lawrence Smith
*Assistant Examiner*—J. C. Peters

[57] ABSTRACT

An improved article of cutlery which in one form of the invention serves either as a spoon or a knife, and which in another form of the invention serves either as a spoon or a fork; in each form of the invention the spoon having a hollow flange or lip along one side and from which either a knife blade or fork teeth are outwardly extendable by means of a flexible push rod that extends into the spoon handle where it is manually controllable by a person's finger so that either implement is selectively used during a meal.

1 Claim, 8 Drawing Figures

Fig. 3
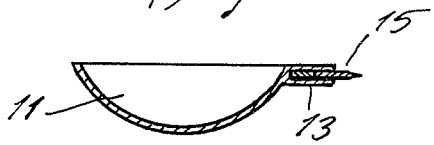
Fig. 1
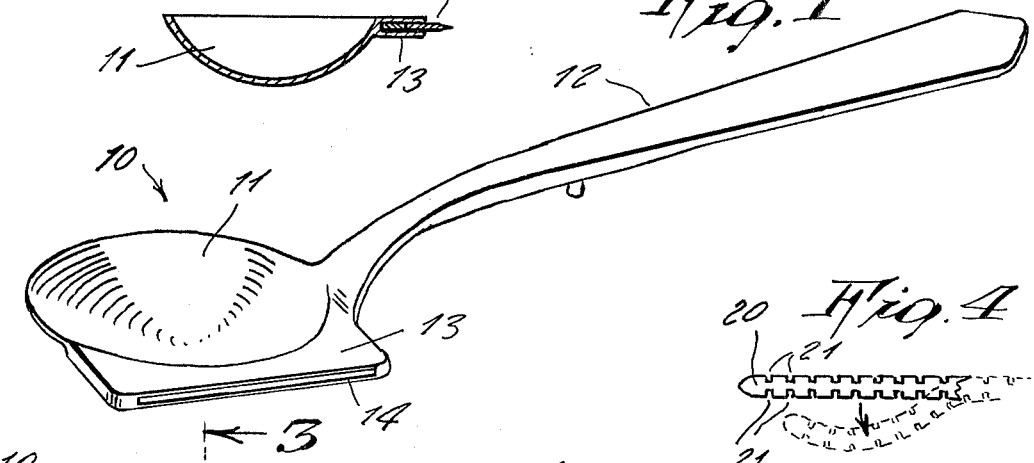
Fig. 4
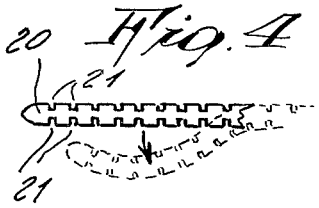
Fig. 2
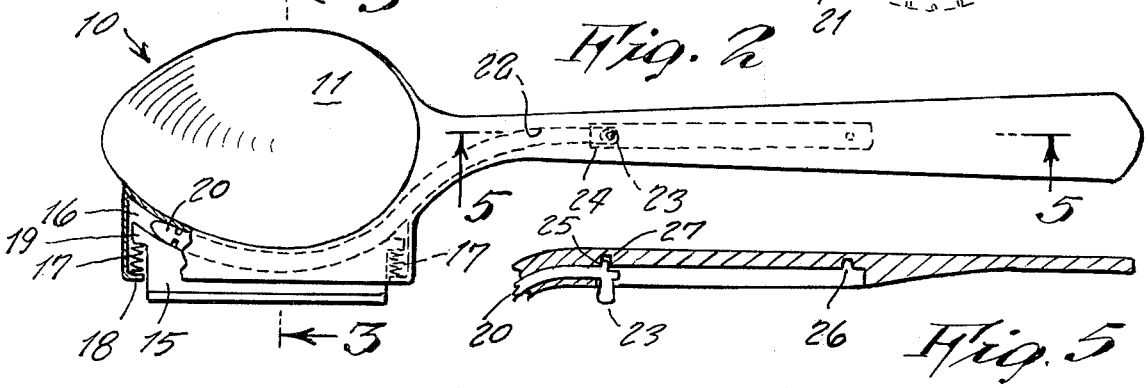
Fig. 5
Fig. 6
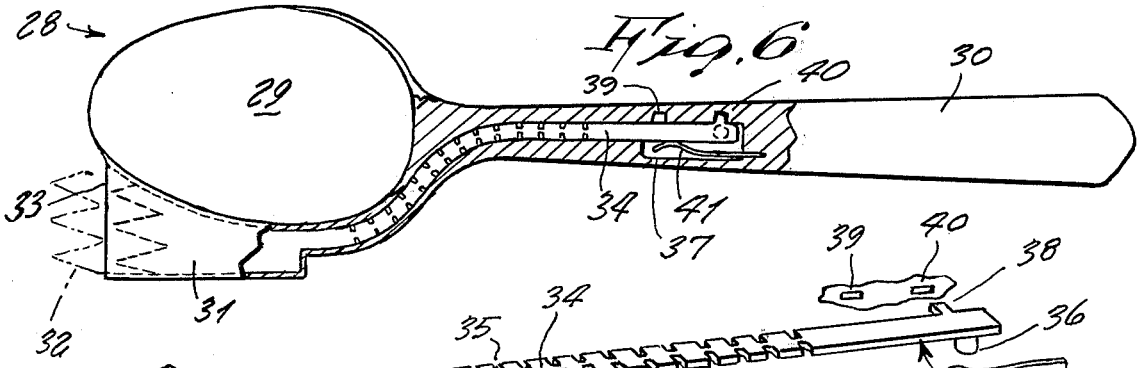
Fig. 7
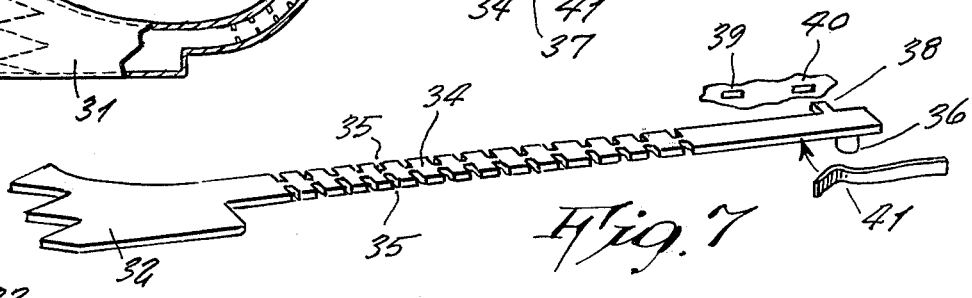
Fig. 8
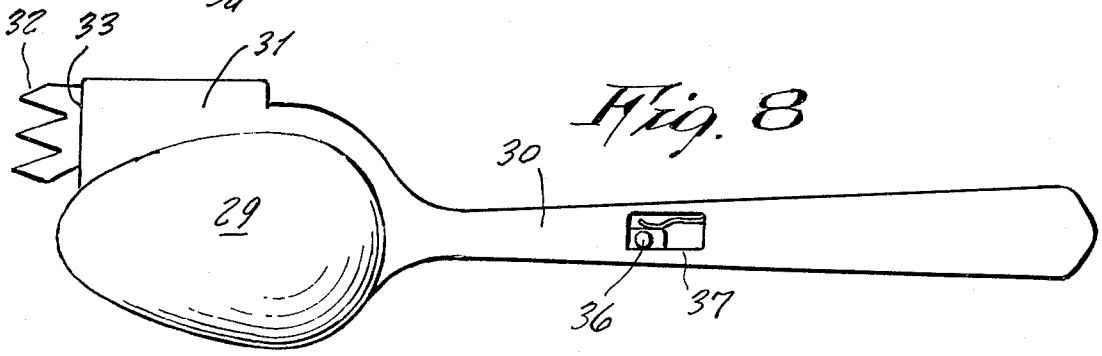

CLEAN UP/CUT SPOON

This invention relates generally to cutlery such as spoons, knives and forks.

A principle object of the present invention is to provide a novel article of cutlery in which a single article of silverwear selectively can be used as either of two different feeding implements.

Another object is to provide a feeding implement which is one form of the invention serves either as a spoon or knife, and which in another form of the invention serves either as a spoon or fork.

Still another object is to provide a feeding implement in which the knife or fork are retractable when not in use so that they are out of the way.

Yet a further object is to provide a feeding implement wherein a sideward flange on a spoon bowl has a straight side edge so the flange serves as a scraper for scraping soft food clean from a dish while eating.

Other objects are to provide a clean up/cut spoon which is simple in design, inexpensive to manufacture, rugged in construction, easy to use and efficient in operation.

These and other object will be readily evident upon a study of the following specification and the accompanying drawing wherein:

FIG. 1 is a perspective view of the invention.

FIG. 2 is a top plan view of the invention shown in FIG. 1, partly in cross-section.

FIG. 3 is a cross section view through section 3—3 of FIG. 1.

FIG. 4 is a top view of a component shown in FIG. 2.

FIG. 5 is a cross section view through section 5—5 of FIG. 2.

FIGS. 6 and 8 are top views of a modified form of the invention.

FIG. 7 is a perspective view of a component of the modified form shown in FIGS. 6 and 8.

Referring now to the drawing in detail, and more particularly to FIGS. 1 to 5 at this time, the reference numeral 10 represents a clean up/cut up spoon according to the present invention wherein there is a spoon bowl 11 integrally formed at one end of a handle 12, the spoon bowl having a hollow flange or lip 13 formed along one side edge thereof. An opening 14 along the outer side edge of the flange permits a knife blade 15 to be extended outwardly from the flange interior 16. Normally the blade is retained in a retracted, hidden position inside the flange by means of springs 17 that bear at one end against end walls 18 of the flange and which at their opposite end bear against a tabs 19 of the blade.

In order that the blade may be projected outwardly of the flange opening 14 when desired to be used, a flexible, flat push rod 20 is designed to be pushed from the interior of the handle 12 and behind the blade so that it is made to outwardly extend as shown in FIG. 2. The push rod is a thin, flat strip of equal thickness as the blade, and can be of flexible plastic or of stainless steel. If made of metal, notches 21 on opposite side edges will allow the necessary flex so it can make the bending in opposite bend directions of the channel 22 within which it slides. A knob 23 secured under the end of the push rod extends outwardly of a slot 24 on the underside of the handle so it can be operated by a person's fingers. A tooth 25 on the push rod is selectively engagable in either depression 26 or 27 so to retain the blade in fixed retracted or extended position by preventing the push rod to slide, so that the fingers are freed from holding the knob after an adjustment is made.

Thus selectively the complement serves either as a spoon or knife.

In FIGS. 6 to 8, a modified design of implement 28 consists of spoon bowl 29 integral with handle 30. A hollow flange 31 on a side of the bowl contains a fork 32 that is slidable inwardly or outwardly of a front opening 33 of the flange so that in retracted position it is hidden and in an extended position it projects further forwardly than a front end of the spoon bowl. In this form of the invention, the push rod 34 is integrally stamped with the fork so is of metal and includes notches 35 for flexing. The push rod end is sidewardly flexible by sideward movement of knob 36 in slot 37 so that tooth 38 is engagable either in depressions 39 or 40 so to retain the fork in either slided position, a leaf spring 41 holds the tooth in the selected depression.

Thus a modified design is provided.

While various changes may be made in the detail construction, it is understood that such changes will be within the spirit and scope of the present invention as is defined by the appended claims.

What is claimed is:

1. In an article of cutlery, a feeding implement having means to be selectively used as either one of several different conventional feeding implements, said implement comprising a spoon bowl integral with a handle, a flange integral with one side edge of said bowl, an outer side edge of said flange being straight so that said flange serves as a food scraper, said flange being hollow and containing a second feeding implement slidable inwardly or outwardly of an opening in said flange, wherein a push rod slidable in a longitudinal channel within said handle serves to selectively slide said second feeding implement inwardly or outwardly of said flange, wherein a knob on an end of said push rod projects outward of a slot in said handle for manual control to slide said push rod, wherein said second implement comprises a fork integral with said push rod and which is slidable from a front end of said flange.

* * * * *